US009476261B2

(12) United States Patent
Venugopal et al.

(10) Patent No.: US 9,476,261 B2
(45) Date of Patent: Oct. 25, 2016

(54) MITIGATION OF ROTATIONAL VIBRATION USING A TORSIONAL TUNED MASS DAMPER

(71) Applicants: Suresh Venugopal, The Woodlands, TX (US); Jayesh R. Jain, The Woodlands, TX (US); Hanno Reckmann, Nienhagen (DE); Bernhard Meyer-Heye, Bremen (DE)

(72) Inventors: Suresh Venugopal, The Woodlands, TX (US); Jayesh R. Jain, The Woodlands, TX (US); Hanno Reckmann, Nienhagen (DE); Bernhard Meyer-Heye, Bremen (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 310 days.

(21) Appl. No.: 13/692,326

(22) Filed: Dec. 3, 2012

(65) Prior Publication Data

US 2014/0151122 A1 Jun. 5, 2014

(51) Int. Cl.
*E21B 17/07* (2006.01)
*E21B 47/01* (2012.01)

(52) U.S. Cl.
CPC ..... *E21B 17/073* (2013.01); *E21B 47/011* (2013.01)

(58) Field of Classification Search
CPC ..... E21B 17/073; E21B 17/076; E21B 47/0006; E21B 44/00; E21B 44/005
See application file for complete search history.

(56) References Cited

U.S. PATENT DOCUMENTS 2,122,026 A * 6/1938 Cullbertson ..... E21B 17/073 33/311
3,230,740 A * 1/1966 Fox ..... E21B 17/073 175/322
3,503,224 A 3/1970 Grigore
3,998,443 A 12/1976 Webb
4,098,373 A 7/1978 Troyer (Continued)

OTHER PUBLICATIONS

Meinhardt, C., "Application of Tuned Mass Dampers for Bridge Decks". Essen, Germany: Gerb Vibration Control Systems. pp. 1-9.

(Continued)

*Primary Examiner* — Jennifer H Gay
(74) *Attorney, Agent, or Firm* — Cantor Colburn LLP

(57) ABSTRACT

An apparatus for reducing vibration includes a damping assembly configured to be fixedly attached to a downhole component. The downhole component is configured to rotate within a borehole in an earth formation, and the damping assembly has a damping frequency that is tuned relative to a selected natural vibration frequency of the rotating downhole component to reduce vibration due to component rotation.

21 Claims, 6 Drawing Sheets

(56) References Cited

U.S. PATENT DOCUMENTS

| | | | | |
|---|---|---|---|---|
| 4,162,619 | A | 7/1979 | Nixon, Jr. | |
| 4,439,167 | A | 3/1984 | Bishop et al. | |
| 4,502,552 | A | 3/1985 | Martini | |
| 4,571,215 | A | 2/1986 | Hansen | |
| 4,779,852 | A * | 10/1988 | Wassell | 267/125 |
| 4,901,806 | A | 2/1990 | Forrest | |
| 5,117,926 | A * | 6/1992 | Worrall et al. | 175/56 |
| 5,678,460 | A * | 10/1997 | Walkowc | F16F 9/535 464/180 |
| 5,941,133 | A | 8/1999 | Wierzba et al. | |
| 5,988,336 | A * | 11/1999 | Wendt | F16D 37/008 188/267.1 |
| 6,308,940 | B1 * | 10/2001 | Anderson | 267/125 |
| 6,327,539 | B1 * | 12/2001 | Keultjes et al. | 702/42 |
| 7,036,612 | B1 * | 5/2006 | Raymond et al. | 175/321 |
| 7,219,752 | B2 | 5/2007 | Wassell et al. | |
| 7,578,360 | B2 | 8/2009 | Haughom | |
| 7,748,474 | B2 * | 7/2010 | Watkins et al. | 175/56 |
| 7,984,771 | B2 * | 7/2011 | Pabon et al. | 175/56 |
| 7,997,380 | B2 * | 8/2011 | Arian | E21B 47/16 181/102 |
| 8,087,476 | B2 * | 1/2012 | Wassell et al. | 175/40 |
| 8,589,136 | B2 * | 11/2013 | Ertas et al. | 703/10 |
| 2004/0129457 | A1 * | 7/2004 | McNeilly | 175/57 |
| 2005/0279565 | A1 * | 12/2005 | Arian | G01V 1/523 181/121 |
| 2006/0185905 | A1 * | 8/2006 | Haughom | 175/321 |
| 2006/0243489 | A1 * | 11/2006 | Wassell et al. | 175/57 |
| 2007/0289778 | A1 * | 12/2007 | Watkins et al. | 175/40 |
| 2009/0023502 | A1 | 1/2009 | Koger | |
| 2010/0224410 | A1 * | 9/2010 | Wassell et al. | 175/40 |
| 2011/0120772 | A1 * | 5/2011 | McLoughlin et al. | 175/56 |
| 2011/0198126 | A1 | 8/2011 | Swietlik et al. | |
| 2011/0245980 | A1 * | 10/2011 | Nessjoen et al. | 700/280 |
| 2012/0085581 | A1 * | 4/2012 | Wassell et al. | 175/40 |
| 2014/0151122 | A1 * | 6/2014 | Venugopal et al. | 175/40 |
| 2014/0262650 | A1 * | 9/2014 | Eppink | E21B 17/076 188/297 |

OTHER PUBLICATIONS

Nils Reimers. (2012). "Antistall Tool Reduces Risk in Drilling Difficult Formations. Journal of Petroleum Technology", 26-29. [retrieved on Mar. 6, 2013] Retrieved from URL http://www.spe.org/jpt/article/2093-technology-update-6/.

Rudolph, M., & Popp, K. (2003). Prevention of stickslip vibrations by passive normal control. Proceedings in applied mathematics and mechanics, 2, 68-69 (2003).

Lesso, et al., "Testing the Combination of High Frequency Surface and Downhole Drilling Mechanics and Dynamics under a Variety of Drilling Conditions". SPE/IADC 140347, Drilling Conference & Exhibition. Amsterdam, The Netherlands, Mar. 1-3, 2011, 16 pg.

* cited by examiner

MITIGATION OF ROTATIONAL VIBRATION USING A TORSIONAL TUNED MASS DAMPER

BACKGROUND

Various types of drill strings are deployed in a borehole for exploration and production of hydrocarbons. A drill string generally includes drill pipe and a bottomhole assembly (BHA). While deployed in the borehole, the drill string may be subject to a variety of forces or loads. For example, the BHA or other components can experience rotation vibrations having various frequencies. Such vibrations, including high frequency vibrations, can cause irregular downhole rotation and reduce component life.

SUMMARY

An apparatus for reducing vibration includes: a damping assembly configured to be fixedly attached to a downhole component, the downhole component configured to rotate within a borehole in an earth formation, the damping assembly having a damping frequency that is tuned relative to a selected natural vibration frequency of the rotating downhole component to reduce vibration due to component rotation.

A method of reducing vibration includes: disposing a downhole component into a formation, the downhole component fixedly attached to a damping assembly, the downhole component configured to rotate within a borehole in an earth formation; performing a downhole operation that includes rotating the downhole component; and reducing vibration due to component rotation by the damping assembly, the damping assembly having a damping frequency that is tuned relative to a selected natural vibration frequency of the rotating downhole component.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION OF THE INVENTION

Disclosed are exemplary apparatuses, systems and methods for reducing or mitigating harmful vibrations that occur in downhole components, such as drill strings and bottomhole assemblies (BHAs), during borehole operations. An embodiment of an apparatus and method include utilization of a tuned mass damper (TMD) disposed in one or more downhole components of a borehole string as an added degree of freedom to mitigate rotational oscillations occurring in the string. In one embodiment, the tuned mass damper is actively tuned to damp rotational oscillations having high frequencies that occur due to rotational motion of the string.

Figure 1:
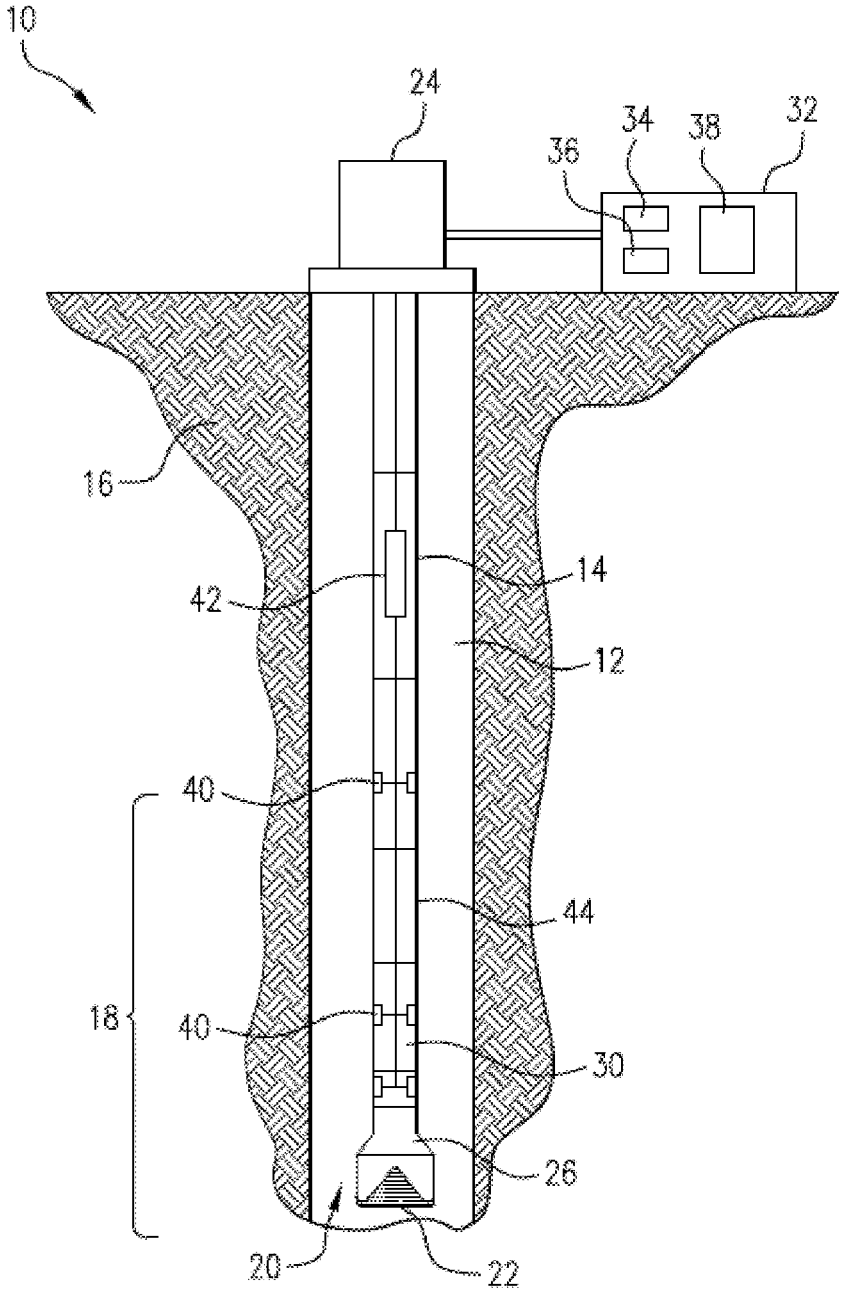
FIG. 1 depicts an exemplary embodiment of a drilling system including a drill string disposed in a borehole in an earth formation and a damping assembly.

Referring to FIG. 1, an exemplary embodiment of a downhole drilling system 10 disposed in a borehole 12 is shown. A drill string 14 is disposed in the borehole 12, which penetrates at least one earth formation 16. The drill string 14 is made from, for example, a pipe or multiple pipe sections. The system 10 and/or the drill string 14 include a drilling assembly 18. Various measurement tools may also be incorporated into the system 10 to affect measurement regimes such as logging-while-drilling (LWD) applications.

As described herein, "string" refers to any structure or carrier suitable for lowering a tool or other component through a borehole or connecting a drill bit to the surface, and is not limited to the structure and configuration described herein. The term "carrier" as used herein means any device, device component, combination of devices, media and/or member that may be used to convey, house, support or otherwise facilitate the use of another device, device component, combination of devices, media and/or member. Exemplary non-limiting carriers include casing pipes, wirelines, wireline sondes, slickline sondes, drop shots, downhole subs, bottomhole assemblies and drill strings.

The drilling assembly 18, which may be configured as a bottomhole assembly (BHA), includes a drill bit 20 that is attached to the bottom end of the drill string 14 via various drilling assembly components. The drilling assembly 18 is configured to be conveyed into the borehole 12 from a drilling rig 24. The drilling assembly components includes various components that provide structural and operational support to the drill bit 20 and to drill bit cutters 22, as well as operably connect the drill bit 20 and the cutters 22 to the drill string 14. Exemplary drilling assembly components include a drill bit body 26 operably connected to the cutters 22, and other drilling assembly components 30, such as a drilling motor, stabilizer and/or steering assembly.

A processing unit 32 is connected in operable communication with the drilling assembly 18 and may be located, for example, at a surface location, a subsea location and/or a surface location on a marine well platform or a marine craft. The processing unit 32 may also be incorporated with the drill string 14 or the drilling assembly 18, or otherwise disposed downhole as desired. The processing unit 32 may be configured to perform functions such as controlling the drilling assembly 18, transmitting and receiving data, processing measurement data, monitoring the drilling assembly 18, and performing simulations of the drilling assembly 18 using mathematical models. The processing unit 32, in one embodiment, includes a processor 34, a data storage device (or a computer-readable medium) 36 for storing, data, models and/or computer programs or software 38.

In one embodiment, the drill bit 20 and/or drilling assembly 18 includes one or more sensors 40 and related circuitry for estimating one or more parameters relating to the drilling assembly 18. For example, a distributed sensor system (DSS) is disposed at the drilling assembly 18 and includes a plurality of sensors 40. The sensors 40 perform measurements associated with the motion of the drilling assembly 18 and/or the drill string 14, and may also be configured to measure environmental parameters such as temperature and pressure. Non-limiting example of measurements performed by the sensors include vibrations, accelerations, velocities, distances, angles, forces, moments, and pressures. In one embodiment, the sensors 40 are coupled to a downhole electronics unit 42, which may receive data from the sensors 40 and transmit the data to a processing system such as the processing unit 32. Various techniques may be used to transmit the data to the processing unit 32, such as mud pulse, electromagnetic, acoustic telemetry, or wired pipe.

Figure 2A:
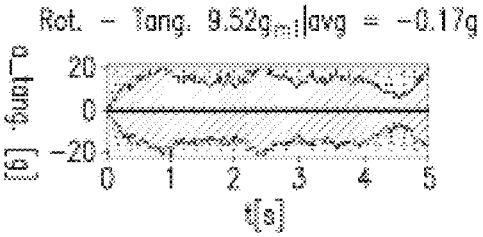
FIGS. 2A, 2B and 2C (collectively referred to as FIG. 2) depict representations of exemplary high frequency oscillations experienced during a drilling operation.
Figure 2B:
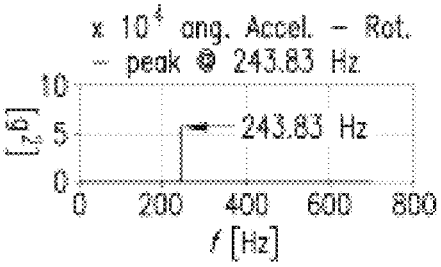
Figure 2C:
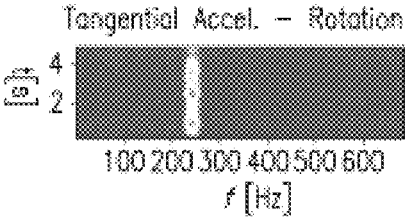

In order to reduce or mitigate such vibrations, the system 10 includes a tuned damping assembly 44 configured to mitigate rotational vibrations experienced by BHAs or other component. As described herein, "rotational vibrations" refer to vibrations that occur due to the rotational motion of the string and/or components thereof (e.g., BHAs, Logging-while-drilling subs, drill bits and others). Rotational vibrations can be distinguished from vibrations due to axial movement, e.g., due to the drill bit contacting the bottom of the borehole, and vibrations due to stick-slip and other behaviors. Exemplary rotational vibrations include high frequency vibrations (e.g., on the order of hundreds of Hz), although rotational vibrations can be experienced at various other frequencies, and thus rotational vibration frequencies that can be mitigated or reduced by the damping assembly 44 are not limited to the specific examples described herein. In one example, such high frequency rotational vibrations can occur at about 25 Hz to about 300 Hz or higher. Exemplary high frequency rotations are illustrated in FIG. 2, which shows measured high frequency vibrations at and around about 244 Hz. Rotational vibrations described herein may have various frequencies and amplitudes; such frequencies and amplitudes are not limited to the examples described herein.

In one embodiment, the damping assembly 44 includes a tuned mass damper (TMD). A TMD is a vibrating auxiliary mass that has vibration movements that are contrary to those of the component or structure to which it is attached. The auxiliary mass is elastically supported and tuned for the frequency that is to be reduced or eliminated. Vibration of the auxiliary mass causes inertial forces that compensate the component's movements by depriving vibration-energy from the component, which increases damping.

Figure 3:
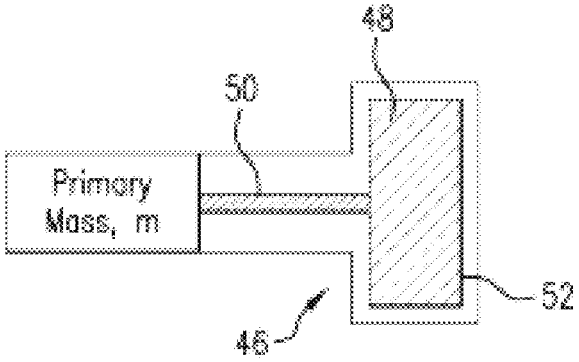
FIG. 3 depicts an exemplary damping configuration.

FIG. 3 illustrates components and principles of a tuned mass damping configuration, which includes a tuned mass damper (TMD) 46 coupled to a primary mass. A TMD configured for downhole use may utilize a portion of the string 14 as the primary mass. A TMD provides an added degree of freedom attached to the vibrating surface to eliminate or attenuate the magnitude of vibration. The TMD 46 includes an auxiliary mass $m_a$, also referred to as an inertia mass 48, that is connected to a vibrating primary mass m through a tuning spring 50 of stiffness k. In one embodiment, a viscous fluid 52 having a viscous damping coefficient c is disposed (e.g., within a housing) between a surface of the inertia mass 48 and an inner surface of the housing. The primary mass may be any suitable component of the string 14, such as a pipe section, the drilling assembly 18 or a separate component or subassembly such as a damper sub.

Figure 4:
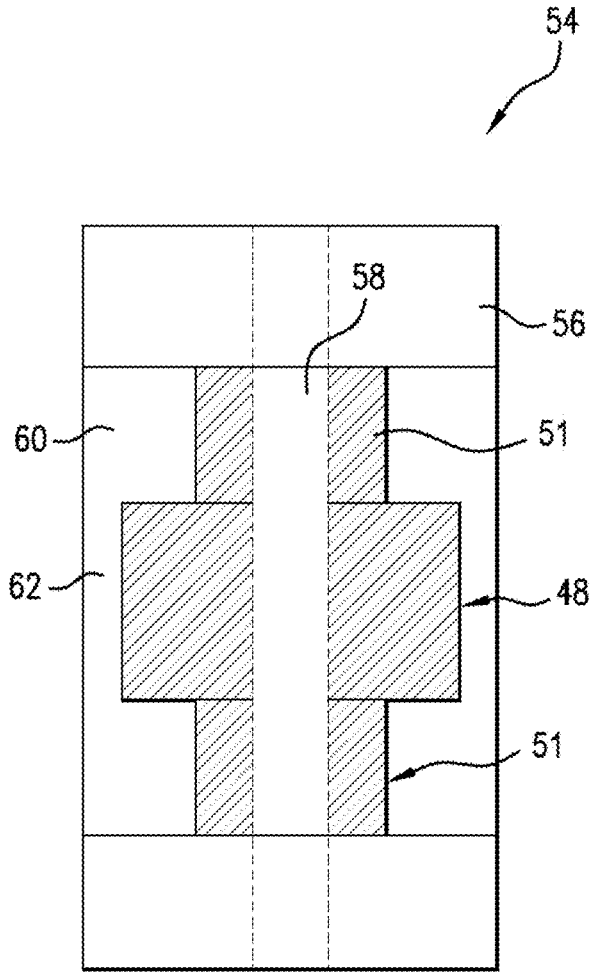
FIG. 4 depicts an exemplary embodiment of a damping subassembly connected to the drill string of FIG. 1.
Figure 5:
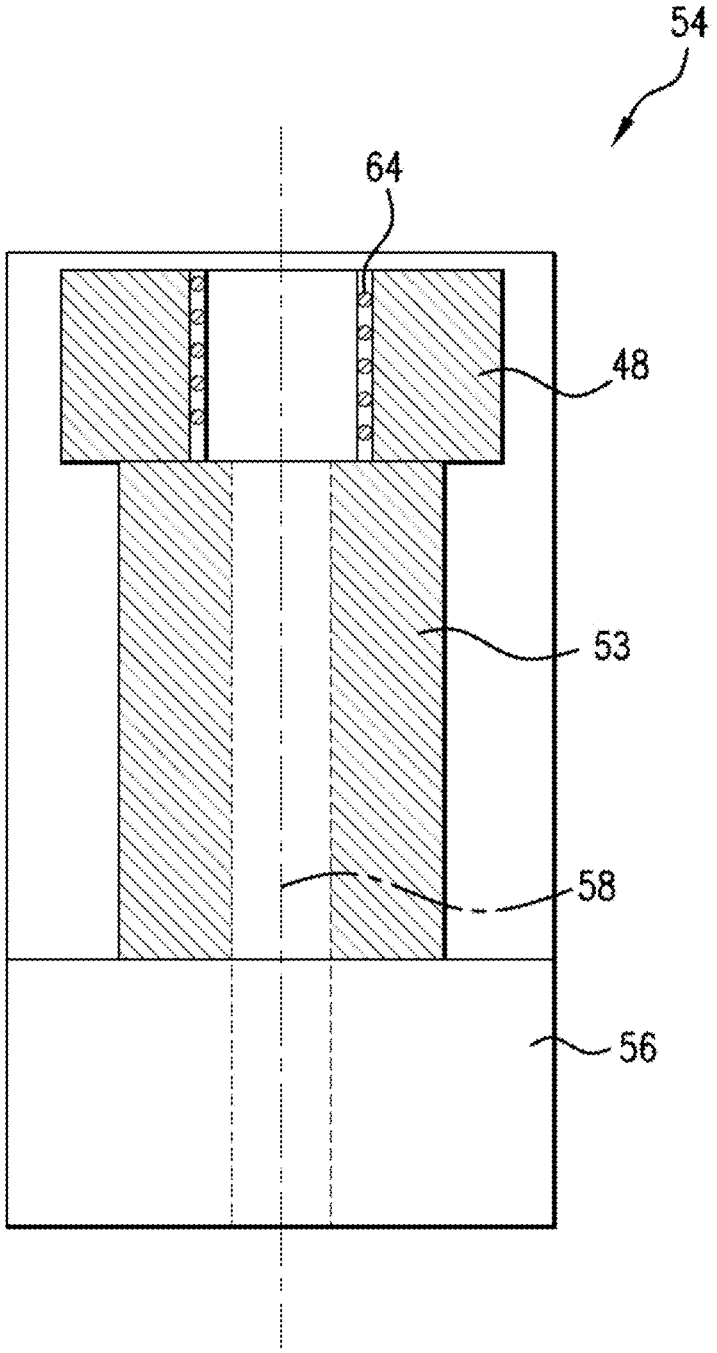
FIG. 5 depicts an exemplary embodiment of a damping subassembly connected to the drill string of FIG. 1.

FIGS. 4 and 5 show exemplary embodiments of the damping assembly 44. In these embodiments, the damping assembly 44 is incorporated as a subassembly or other carrier that can be incorporated as part of the drill string. For example, FIGS. 4 and 5 show the damping assembly 44 incorporated into a tuned damping sub 54 attached between the drill bit 20 and another sub, or above a BHA. The damping assembly 44 is configured with a damping frequency that is tuned to reduce vibrations corresponding to a selected natural frequency of the drill string or other component. In one embodiment, the damping assembly is configured as a passive device having a damping frequency that is tuned prior to deploying the drill string or otherwise performing a downhole operation. In one embodiment, the damping assembly is configured as an active device whose damping frequency can be tuned downhole and/or during the downhole operation.

The damping sub 54 includes a housing 56 that defines or includes an interior cavity 60, within which the damping assembly 44 is disposed. The housing 56 or a portion thereof is attached to the damping assembly 44 such that rotational motion is transferred from the housing 56 to the assembly 44. The housing 56 is attached or coupled to the drill string 14 and/or drilling assembly such that torque is transferred from the mud motor or surface drive.

In the example of FIG. 4, the assembly 44 includes a torsion spring 51 axially extending from the inertia mass 48. In this example, a separate spring 51 extends from an upper end and a lower end of the mass 48 to the housing 56. As described herein, a "spring" may be any suitable component that is capable of storing mechanical energy in response to torsional movement, and is not limited to the types and configurations described herein. As indicated above, the spring 51 may be a component, such as a torsion spring, that has torsional flexibility and is capable of storing mechanical energy when twisted. For example, the spring 51 may be a helical torsion spring, a solid or hollow torsion bar, or a thin hollow pipe or cylinder extending from the mass 48. Other examples of suitable springs include longitudinal springs mounted on a rotating component in a tangential position relative to the component's rotational axis.

In one embodiment, the damping sub 54 includes a conduit or other mechanism to allow fluid to be circulated or advanced therethrough, such as drilling fluid to be circulated during a drilling operation. For example, the housing 56 and/or the damping assembly 44 may define a fluid conduit 58 or other means to allow fluid such as drilling mud to flow therethrough. The mass 48 may be formed as a ring having a central opening, and the hollow pipe, the mass 48 and the housing 56 define a central fluid conduit 58.

In one embodiment, the cavity 60 is configured to retain a viscous damping fluid therein. For example, as shown in FIG. 4, the housing 56 includes a hollow cylinder that forms the cavity 60. The fluid may be any suitable fluid having a viscosity (fixed or variable) that provides a damping effect. Exemplary fluids include silicone-based damping fluids and hydraulic oils.

The damping fluid viscosity provides a damping effect due to viscous resistance to shear created by the relative movement of the mass 48 and the housing 56 or other primary mass. In some embodiments, the inertial or auxiliary mass 48 has a shape configured to provide a gap a having a relatively constant thickness that is sufficient to produce a damping effect based on shear resistance. For example, the inertial mass 48 has a cylindrical or toroid shape defining an outer surface that works in conjunction with the damping fluid and a cylindrical inner surface of the cavity.

For example, as shown in FIG. 4, a gap or clearance space 62 is formed within the cavity 62 between the inertia mass 48 and the housing 56. The fluid in the gap forms a viscous film having a damping coefficient c.

In one embodiment, shown in FIG. 5, the housing 56 (or other primary mass ma) is mounted on a bearing 64 connected to the BHA by a spring 53 having a selected torsional stiffness ka. Damping action can be added by using fluid between this assembly and the hollow sub as described above.

In one embodiment, the assembly 44 is configured as an active tuned damping assembly having damping properties or parameters that can be actively adjusted or tuned prior to deployment and/or downhole during a drilling operation. The assembly can be tuned by actively changing damping parameters such as damping properties of the fluid, stiffness properties of the spring 53 or inertia properties of the inertia mass 48. The parameters may be adjusted or controlled by a user (e.g., a human operator) and/or processor. For example, the surface processing unit 32 and/or the downhole electronics unit 42 may be configured as a controller that receives vibration and/or rotation information from the sensors 40 and adjusts damping parameters based on such information. The controllers may use various types of devices or actuators for adjusting the damping, such as an electric device, e.g., a coil in a magnetic field or an eddy current brake.

In one embodiment, the assembly is configured to adjust characteristics of the damping fluid. For example, viscosity of the fluid may be adjusted using various catalysts or the fluid can be tuned by adjusting an orifice or a throttle.

An exemplary damping fluid has a viscosity that is adjustable based on exposure to a catalyst. For example, the fluid is a smart fluid such as a magnetorheologic (MR) fluid having a viscosity that can be adjusted by applying a magnetic field. In this example, an actuator such as an electromagnet is included proximate to the fluid, e.g. inside or near the cavity 60 and/or the gap 62, for application of the magnetic field. The electromagnet may be electrically connected to a surface or downhole power source that is controlled by a processor such as the surface processing unit 32. Other examples of catalysts that may be used with this embodiment include electrodes applied to electrorheologic fluids, temperature controls and chemical additives that can be applied to the fluid, e.g., via a reservoir and controllable valve in the damping sub 54, to alter the fluid viscosity.

In one embodiment, the physical and/or inertial properties of the inertia mass 48 are adjustable to change the natural frequency of the assembly 44. For example, the inertia mass may include a hydraulically expandable or retractable ring, or a piezoelectric material. Adjustment of the inertia mass 48 results in a change in rotational inertia, which in turn changes the natural frequency of the assembly.

In one embodiment, the spring stiffness can be adjusted downhole. For example, the spring may be a variable stiffness spring that includes an actuator connected to the spring 50. The actuator can be actuated by a suitable mechanism (e.g., electric, pneumatic or hydraulic) to apply a twisting force to the spring 50.

The embodiments described herein can be used to adjust the natural damping frequency $\omega_a$ of the assembly 44 relative to a selected natural frequency $\omega_n$ of the rotating string or other component. In one embodiment, the drill string or other downhole component may have multiple natural frequencies, and the assembly is adjusted to one of these frequencies, such as the natural frequency that is or would be considered most harmful.

The damping response of the component depends on the ratio of these two frequencies. The response is the least when the ratio is equal to unity, and thus an optimal tuned frequency of the damping assembly 44 may be selected as a fraction or percentage of the natural frequency $\omega_n$.

Figure 6:
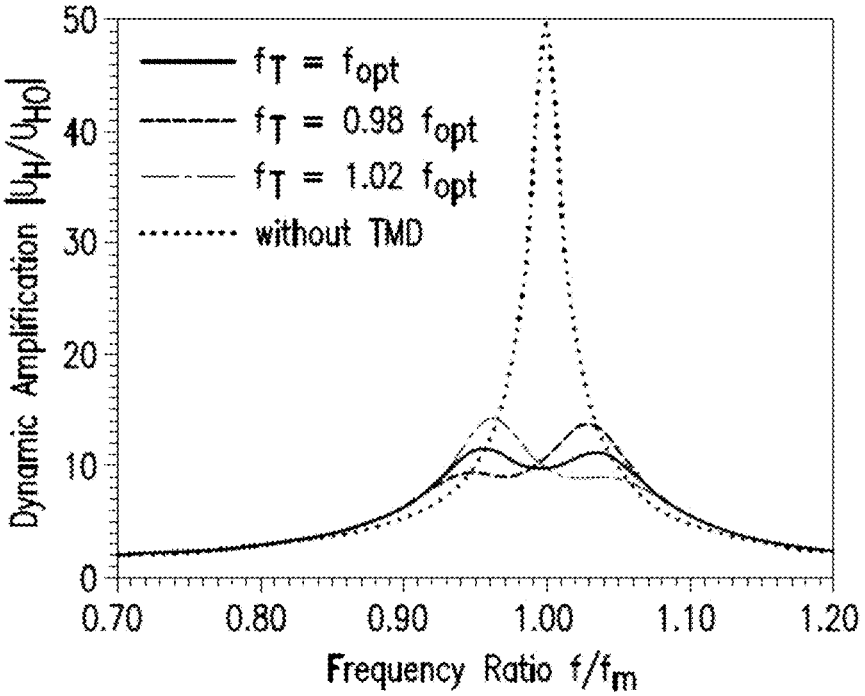
FIG. 6 illustrates exemplary damping effects of the damping assembly of FIG. 1.

For example, FIG. 6 shows the dynamic amplification of an applied vibrational load as a function of the ratio of the component vibrational frequency and the component's natural frequency. FIG. 6 demonstrates the effect of a TMD on amplification for several tuning frequencies. As shown, application of the TMD provides significant damping of the component's natural frequency when the TMD tuned frequency $f_T$ is at or near an optimal frequency $f_{opt}$.

In one embodiment, one or more computer models of rotating components based on, e.g., the finite element method or other numerical methods may be used to identify the component's natural frequency and the frequency to be tuned. Such computer models may utilize modal, forced vibration or transient analysis in the time domain, frequency domain, or a hybrid domain. The model may be generated prior to deploying the assembly and/or generated or updated based on various measurements after deployment, e.g., during a downhole operation. For example, the identified natural frequency based on a model may be used as an initial estimate and then improved in combination with measurements in closed-loop calculations downhole.

Figure 7:
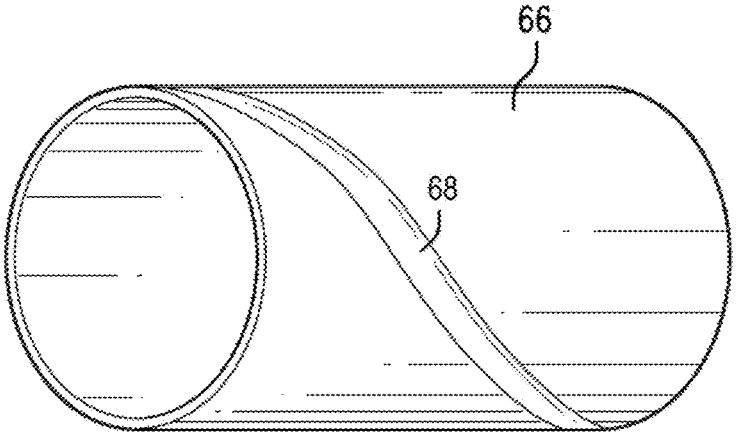
FIG. 7 depicts an exemplary embodiment of a component of the damping assembly of FIG. 1 for translating rotational motion to axial motion.

In one embodiment, the assembly 44 is configured to be able to reduce axial vibration as well as torsional or rotational vibration. For example, the inertia mass 48 or other auxiliary mass is operably connected to a mechanism that couples torsional or rotational movement and axial movement. For example, instead of the bearing 64, the inertia mass 48 is configured as a ring and is mounted on a slanted splined shaft 66 shown in FIG. 7. The inertia mass ring slides in splines 68 on the shaft 66. Movement inside these splines 68 provides the coupling between torsional and axial movement. This type of an arrangement provides fluctuating normal forces to help minimize amplitudes of high frequency rotational oscillations.

The types and configurations of damping assemblies that may be used are not limited to the specific embodiments and configurations described herein. Any suitable damping mechanism that mitigates rotational vibration may be used, such as various types of rotary dampers or rotary dashpot devices.

The damping assembly 44 may be utilized in a method of controlling vibration in a downhole carrier, such as the drill string 14. The method may be executed by a user and/or a computer processing system (e.g., the processing unit 32 and/or the processor 42. The method includes one or more stages. In one embodiment, the method includes the execution of all of stages in the order described. However, certain stages may be omitted, stages may be added, or the order of the stages changed. In addition, the method may be performed in real-time or near real-time during a downhole operation, and may be performed on a substantially continuous or periodic basis.

In a first stage, the carrier, e.g., the drill string 14, is disposed at a borehole or formation, and a drilling operation is commenced. The first stage may also include manufacture, assembly and/or initial tuning of the damping assembly 44, such as by selecting inertia mass properties, selecting or adjusting spring stiffness and/or selecting or adjusting damping fluid properties.

In the second stage, drill string 14 or other component (e.g., BHA) vibration characteristics are measured and/or calculated. For example, the sensors 40 may include vibration sensors, accelerometers, stress or strain sensors or other types of sensors that are used to transmit vibration data, and/or parameters data related to vibration, to a processor or user.

In the third stage, the damping sub 54 is adjusted to adjust the natural frequency of the damping assembly 44, i.e., the damping frequency, to improve or maximize the damping effect on the drill string 14. For example, an electric current or magnetic field is applied to the damping fluid to alter the viscosity and thereby change the damping assembly's frequency to coincide with a selected ratio. In other examples, the spring stiffness may be adjusted, or parameters of the inertial mass are adjusted to change the rotation and/or clearance gap.

The systems, apparatuses and methods described herein provide various advantages over prior art techniques. For example, the apparatuses described herein may be semi-active and/or active designs, having the capability to modify parameters of the damper (e.g., stiffness, damping or inertia) adaptively, such that rotational vibration can be effectively mitigated even as vibrational forces change downhole.

Generally, some of the teachings herein are reduced to an algorithm that is stored on machine-readable media. The algorithm is implemented by the computer processing system and provides operators with desired output.

In support of the teachings herein, various analysis components may be used, including digital and/or analog systems. The digital and/or analog systems may be included, for example, in the downhole electronics unit 42 or the processing unit 32. The systems may include components such as a processor, analog to digital converter, digital to analog converter, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, motive force (such as a translational force, propulsional force, or a rotational force), digital signal processor, analog signal processor, sensor, magnet, antenna, transmitter, receiver, transceiver, controller, optical unit, electrical unit or electromechanical unit may be included in support of the various aspects discussed herein or in support of other functions beyond this disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for reducing vibration, comprising:

a damping assembly configured to be fixedly attached to a downhole component, the downhole component configured to rotate within a borehole in an earth formation, the damping assembly including an auxiliary inertial mass connected to the downhole component via a spring configured to store mechanical energy in response to an applied torque, the inertial mass having a rotational vibration frequency that is selected relative to a selected natural vibration frequency of the rotating downhole component to reduce vibration due to component rotation, the inertial mass configured to vibrate at the selected rotational vibration frequency in response to vibration of the downhole component at the selected natural vibration frequency, the inertial mass configured to vibrate to deprive rotational vibration energy from the downhole component without excitation of inertial property of the inertial mass and a stiffness of the spring is adjustable to alter the selected rotational vibration frequency of the damping assembly.

2. The system of claim 1, further comprising a controller configured to alter the selected rotational vibration frequency of the damping assembly relative to the selected natural vibration frequency.

3. The system of claim 2, wherein the controller is configured to adjust the stiffness of the spring in response to a measurement of the rotational vibration.

4. The system of claim 3, further comprising an actuator configured to adjust a stiffness of the spring.

5. The system of claim 2, wherein the controller is configured to adjust the inertial property of the inertial mass in response to a measurement of the rotational vibration.

6. The system of claim 1, wherein the damping assembly includes a tuned mass damper (TMD).

7. The system of claim 1, wherein the downhole component forms a part of a drill string, and the damping assembly includes at least one conduit configured to advance drilling fluid therethrough.

8. The system of claim 1, wherein the downhole component includes a slanted splined shaft having the inertial mass mounted thereon, the inertial mass configured to slide along one or more splines on the shaft to couple axial and rotational movement.

9. The system of claim 1, wherein the damping assembly includes a damping fluid.

10. The system of claim 1, wherein the inertial mass is configured to be expanded or retracted to change the rotational inertia.

11. The system of claim 1, further comprising a mechanism connected to the inertial mass that is configured to couple axial movement of the downhole component to rotational movement of the damping assembly.

12. A method of reducing vibration, comprising:

disposing a downhole component into a formation, the downhole component fixedly attached to a damping assembly, the downhole component configured to rotate within a borehole in an earth formation, the damping assembly including an auxiliary inertial mass connected to the downhole component via a spring configured to store mechanical energy in response to an applied torque;

performing a downhole operation that includes rotating the downhole component;

estimating a natural vibration frequency of the rotating downhole component; and selecting, by a controller, a rotational vibration frequency of the damping assembly relative to the estimated natural vibration frequency to reduce vibration due to component rotation, wherein selecting includes at least one of, adjusting an inertial property of the inertial mass to change a rotational inertia of the inertial mass and cause the inertial mass to vibrate at the selected rotational vibration frequency in response to vibration of the downhole component at the estimated natural vibration frequency, the inertial mass configured to vibrate to deprive rotational vibration energy from the downhole component without excitation of the damping assembly from an external source of energy; and adjusting a stiffness of the spring by the controller in response to a measurement of the rotational vibration.

13. The method of claim 12, wherein adjusting the physical property includes at least one of expanding and retracting the inertial mass.

14. The method of claim 12, wherein the damping assembly includes a tuned mass damper (TMD).

15. The method of claim 12, wherein the downhole component forms a part of a drill string, and the damping assembly includes at least one conduit configured to advance drilling fluid therethrough.

16. The method of claim 12, wherein the measuring is performed via one or more sensors attached to the downhole component, and the selecting includes receiving vibration information at the controller from the one or more sensors.

17. The method of claim 12, wherein the downhole component includes a slanted splined shaft having the inertial mass mounted thereon, the inertial mass configured to slide along one or more splines on the shaft to couple torsional and rotational movement.

18. The method of claim 12, further comprising adjusting a damping fluid in the damping assembly by the controller in response to a measurement of the rotational vibration.

19. The method of claim 12, further comprising coupling axial movement of the downhole component to torsional movement of the damping assembly by a mechanism connected to the inertial mass, to reduce axial vibration of the downhole component.

20. A method of reducing vibration, comprising:

disposing a downhole component into a formation, the downhole component fixedly attached to a damping assembly, the downhole component configured to rotate within a borehole in an earth formation, the damping assembly including an auxiliary inertial mass connected to the downhole component via a spring configured to store mechanical energy in response to an applied torque;

performing a downhole operation that includes rotating the downhole component;

estimating a natural vibration frequency of the rotating downhole component; and selecting, by a controller, a rotational vibration frequency of the damping assembly relative to the estimated natural vibration frequency to reduce vibration due to component rotation, wherein selecting includes adjusting an inertial property of the inertial mass to cause the inertial mass to vibrate at the selected rotational vibration frequency in response to vibration of the downhole component at the estimated natural vibration frequency and deprive vibration energy from the downhole component; and adjusting a stiffness of the spring by the controller in response to a measurement of the rotational vibration.

21. The method of claim 20, wherein the downhole component includes a slanted splined shaft having the inertial mass mounted thereon, the inertial mass configured to slide along one or more splines on the shaft to couple torsional and rotational movement.

* * * * *